US008491097B2

(12) United States Patent
Suzuki et al.

(10) Patent No.: US 8,491,097 B2
(45) Date of Patent: Jul. 23, 2013

(54) LIQUID EJECTING HEAD AND LIQUID EJECTING APPARATUS

(75) Inventors: Shigeki Suzuki, Shiojiri (JP); Hiroshige Owaki, Okaya (JP); Hiroyuki Kobayashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 217 days.

(21) Appl. No.: 13/178,413

(22) Filed: Jul. 7, 2011

(65) Prior Publication Data

US 2012/0013683 A1 Jan. 19, 2012

(30) Foreign Application Priority Data

Jul. 13, 2010 (JP) ..... 2010-159077

(51) Int. Cl.
*B41J 2/14* (2006.01)
*B41J 2/16* (2006.01)

(52) U.S. Cl.
USPC ..... 347/50

(58) Field of Classification Search
USPC ..... 347/50
See application file for complete search history.

(56) References Cited

U.S. PATENT DOCUMENTS

2010/0214379 A1* 8/2010 Owaki et al. ..... 347/85

FOREIGN PATENT DOCUMENTS

JP 2003-011383 1/2003

* cited by examiner

*Primary Examiner* — Matthew Luu
*Assistant Examiner* — Renee I Wilson
(74) *Attorney, Agent, or Firm* — Workman Nydegger

(57) ABSTRACT

A connector connected to an external wiring is fixed on the circuit board by opening a connection port toward the channel member side, the external wiring is inserted into or released from the connection port, and the channel member has a deformation restricting portion protruding from a region, which is opposite the circuit board, toward the circuit board, and substantially abuts against a surface of the circuit board to restrict deformation of the circuit board to the channel member side.

8 Claims, 8 Drawing Sheets

LIQUID EJECTING HEAD AND LIQUID EJECTING APPARATUS

The entire disclosure of Japanese Patent Application No: 2010-159077, filed Jul. 13, 2010 are expressly incorporated by reference herein.

BACKGROUND

1. Technical Field

The present invention relates to a liquid ejecting head capable of ejecting a liquid, which is supplied from a liquid storage unit to a head main body through a liquid supply passage, from nozzles, and a liquid ejecting apparatus including the liquid ejecting head.

2. Related Art

An ink jet recording head, which is a typical example of a liquid ejecting head, is generally configured such that a pressure generating chamber of a head main body is supplied with ink from an ink cartridge (liquid storage unit), which is filled with the ink, through an ink flow path (fluid flow path). A pressure generating unit such as a piezoelectric element applies pressure to the inside of the pressure generating chamber, so that ink droplets are ejected from nozzles communicating with the pressure generating chamber.

As the specific configuration of the ink jet recording head, for example, including head bodies, a head case fixed with a plurality of head bodies, and a cartridge case fixed with the head case, and a circuit board for supplying a signal to drive a piezoelectric element is fixed between the head case and the cartridge case (for example, refer to JP-A-2003-11383).

As also shown in FIG. 1 of JP-A-2003-11383, a circuit board is provided with a connector, and an external wiring is inserted to or removed from the connector. In these connectors, a connection port, to or from which an external wiring is inserted or released, is fixed to the circuit board so as to open towards the outside of the circuit board in an in-plane direction. In other words, the external wiring is inserted to or released from the connector by adding a force to the circuit board in the in-plane direction. Incidentally, for example, as shown in FIG. 9, a circuit board 900 in the related art, which is provided with a connector 920, is restricted in movement of the in-plane direction of the circuit board 900 by inserting a boss portion 650, which protrudes from a head case 600, to a through-hole 940 provided in the circuit board 900. Even when the external wiring 1000 is inserted to or released from a connection port 930 of the connector 920, the movement of the circuit board 900 in the in-plane direction is restricted by the boss portion 650.

In this way, the movement of the circuit board 900 in the in-plane direction can be restricted by the boss portion 650. However, the boss portion 650 is likely to be broken up by the force generated when the external wiring 1000 is inserted to or released from the connection port 930 of the connector 920. Such a problem can be prevented by increasing the rigidity of the boss portion 650, for example, which results from increasing the diameter of the boss portion 650 or the like. However, since the wiring is formed densely on the circuit board 900, if the diameter of the boss portion 650 is increased, there is a concern that it may not be possible to secure a space for forming the wiring on the circuit board 900. In addition, there is another concern that it may not be possible to secure a space for mounting electronic components on the circuit board 900.

Further, such problems are not only present in ink jet recording heads, but are also present in liquid ejecting heads capable of ejecting a liquid other than ink.

SUMMARY

An advantage of some aspects of the invention is to provide a liquid ejecting head and a liquid ejecting apparatus which can effectively prevent movement of a circuit board, and satisfactorily insert and release an external wiring with respect to a connector of the circuit board.

According to an aspect of the invention, there is provided a liquid ejecting head, including a head main body which ejects a liquid droplet; a case member to which the head main body is fixed; a channel member which is fixed to the case member, and has a liquid supply passage which is connected to a liquid storage unit which stores a liquid; and a circuit board which is provided between the case member and the channel member, and is connected to a pressure generating element configuring the head main body, wherein a connector connected to an external wiring is fixed on the circuit board by opening a connection port toward the channel member side, the external wiring is inserted into or released from the connection port, and the channel member has a deformation restricting portion protruding from a region, which is opposite the circuit board, toward the circuit board, and substantially abuts against a surface of the circuit board to restrict deformation of the circuit board to the channel member side, is provided.

The invention restricts deformation (bending) of the circuit board by the deformation restricting portion. When the external wiring is extracted from the connector provided on the circuit board, the bending of the circuit board is restricted by the deformation restricting portion. That is, the external wiring can be satisfactorily extracted from the connector. In addition, there is no concern in that the circuit board may be deformed and thus damaged when the external wiring is extracted from the connector. Further, since the deformation restricting portion protrudes toward the circuit board, even though the pressure generated when the circuit board is bent is applied to the deformation restricting portion, the deformation restricting portion itself is not damaged.

It is desirable that the deformation restricting portion is provided adjacent to the connector. Accordingly, it is possible to more reliably suppress the bending of the circuit board occurring when the external wiring is extracted from the connector.

In addition, it is desirable that the deformation restricting portion is provided at a plurality of positions on an outer periphery of the circuit board. Accordingly, it is possible to more reliably suppress the generation of the bending of the circuit board.

Further, in a case where the case member and the channel member are fixed to each other by a fastening member in a state in which the circuit board is interposed between the case member and the channel member, it is desirable that the deformation restricting portion is provided adjacent to the fastening member. Accordingly, when the circuit board abuts against the deformation restricting portion, the fastening force of the fastening member acts as a force for suppressing the deformation of the circuit board. Therefore, it is possible to more reliably suppress the bending of the circuit board.

According to another aspect of the invention, there is provided a liquid ejecting apparatus including the liquid ejecting head described above. The invention can improve the durability of the head, which realizes a liquid ejecting apparatus with improved reliability.

BRIEF DESCRIPTION OF THE DRAWINGS

The invention will be described with reference to the accompanying drawings, wherein like numbers reference like elements.

DESCRIPTION OF EXEMPLARY EMBODIMENTS

The following is a detailed description of the embodiments of the invention.

Figure 1:
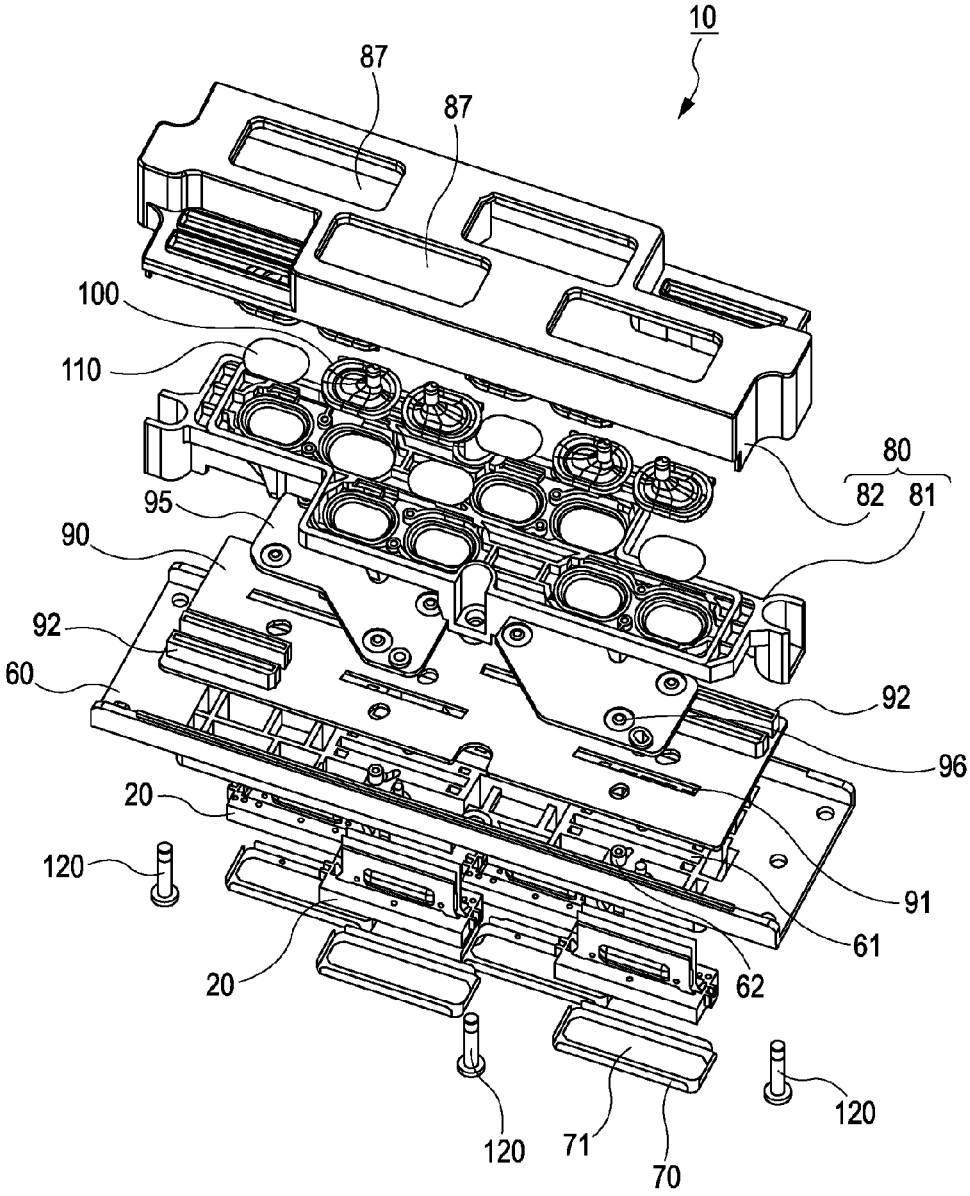
FIG. 1 is a schematic perspective view showing the entire configuration of a recording head according to an embodiment of the invention.
Figure 2:
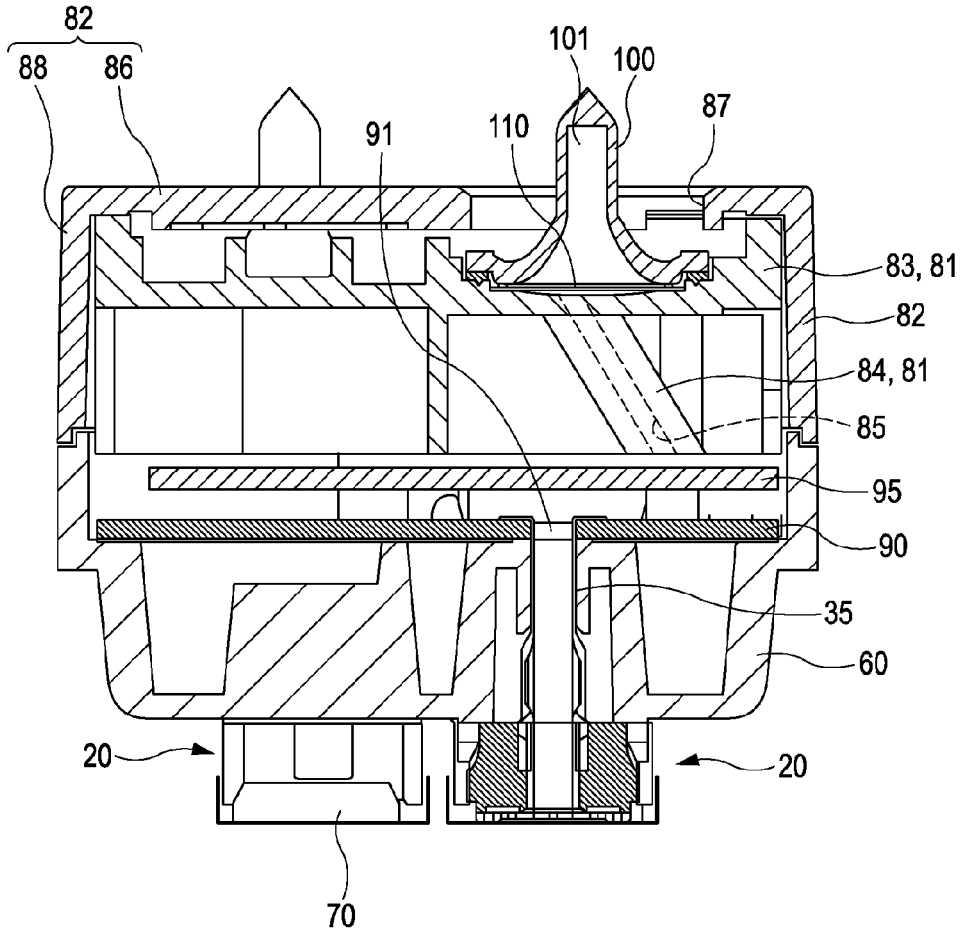
FIG. 2 is a cross-sectional view of an assembled recording head according to an embodiment of the invention.

FIG. 1 is an exploded perspective view of an ink jet recording head which is an example of a liquid ejecting head according to an embodiment of the invention. FIG. 2 is a cross-sectional view of the assembly thereof.

As shown in FIGS. 1 and 2, the ink jet recording head (hereinafter, simply referred to as a "recording head") 10 includes a plurality of head bodies 20 for spraying ink droplets, a case member 60 fixed to the head main body 20, a channel member 80 provided at the opposite side of the head main body 20 of the case member 60, and a circuit board 90 provided between the case member 60 and the channel member 80.

Figure 3:
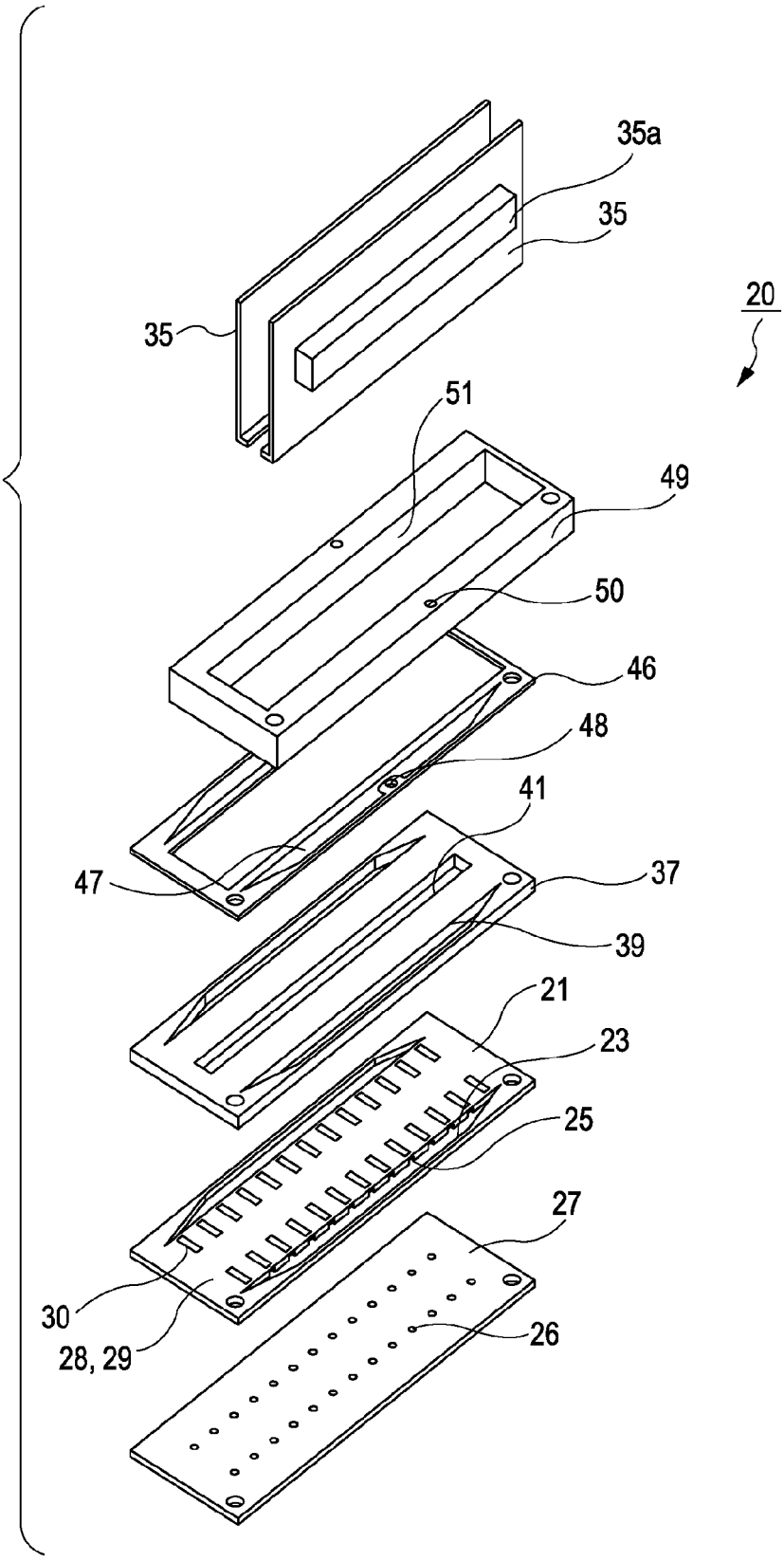
FIG. 3 is an exploded perspective view of a head main body according to an embodiment of the invention.

First, an example of the configuration of the head main body 20 will be described with reference to FIGS. 3 and 4. FIG. 3 is an exploded perspective view of the head main body according to an embodiment, and FIG. 4 is a longitudinal cross-sectional view of a pressure generating chamber of the head main body.

Figure 4:
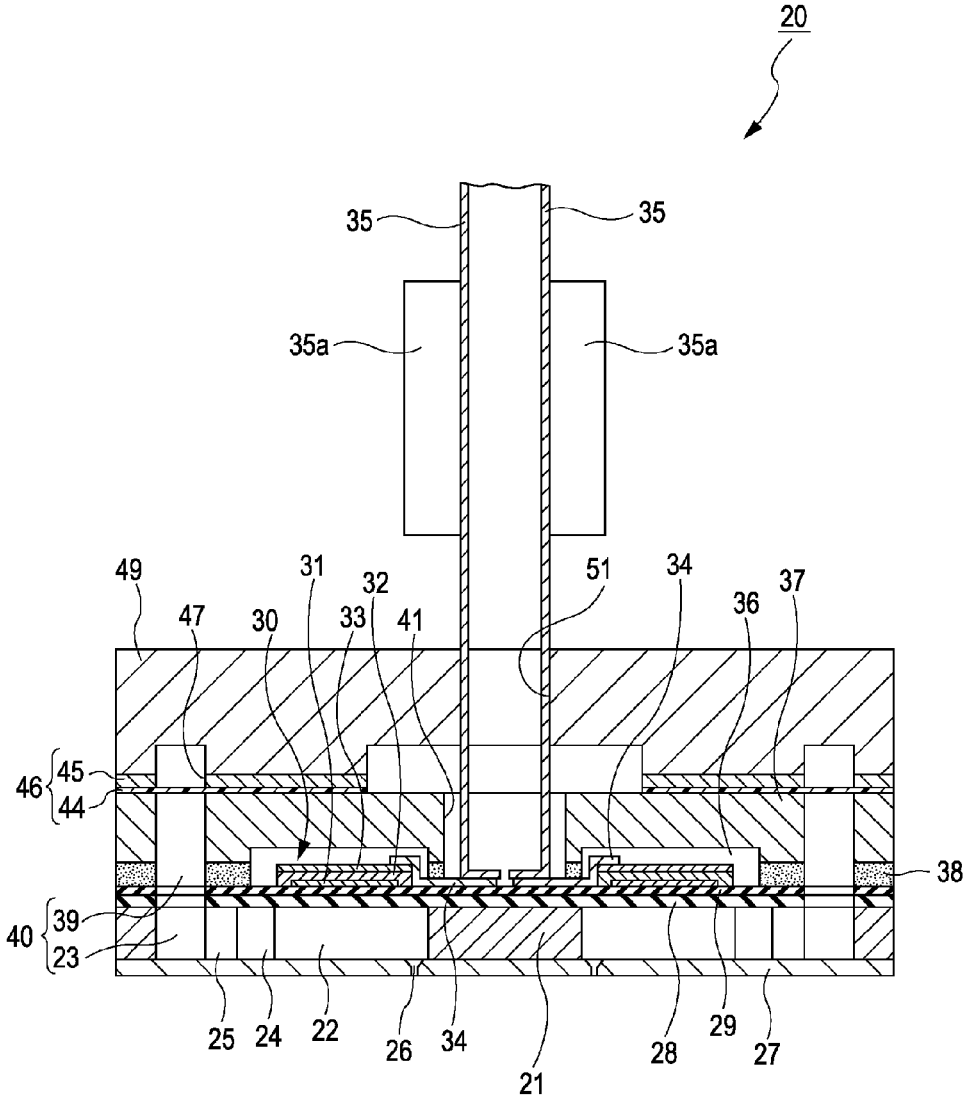
FIG. 4 is a cross-sectional view of a head main body according to an embodiment of the invention.

As shown in FIGS. 3 and 4, a channel forming substrate 21 constituting the head main body 20 is provided with a plurality of pressure generating chambers 22 in which two rows of pressure generating chambers are arranged in parallel in a width direction. In addition, the area outside the pressure generating chambers 22 in each row in the longitudinal direction is provided with a communication portion 23, and the communication portion 23 and the respective pressure generating chambers 22 are communicated with each other via an ink supply passage 24 and a communication passage 25 provided for pressure generating chambers 22.

On one side of the channel forming substrate 21, a nozzle plate 27, in which nozzles 26 are formed by boring the nozzle plate and communicate with the vicinity of an end of the respective pressure generating chambers 22 opposite the ink supply channel 24, is joined.

Meanwhile, the surface opposite the nozzle plate 27 of the channel forming substrate 21 is provided with piezoelectric elements 30 in which an elastic film 28 and an insulating film 29 are interposed between the channel forming substrate and the piezoelectric elements. The piezoelectric elements 30 are configured of a first electrode 31, a piezoelectric layer 32, and a second electrode 33. The second electrode 33 configuring the respective piezoelectric elements 30 is connected to a lead electrode 34 extending to the upper portion of the insulating film 29. The lead electrode 34 has one end connected to one end of the second electrode 33 and the other end connected to a driving wiring 35 which serves as a flexible wiring member (COF substrate) and is provided with a driving IC 35*a* for driving the piezoelectric elements 30. One end of the driving wiring 35 is connected to the lead electrode 34, and the other end of driving wiring 35 is fixed to the circuit board 90 (refer to FIG. 2).

On the channel forming substrate 21 provided with the piezoelectric elements 30, a protection substrate 37 is joined by an adhesive 38 in a region opposite the piezoelectric elements 30, the protection substrate having a piezoelectric element holding portion 36 which is a space for protecting the piezoelectric element 30. In addition, the protection substrate 37 is provided with a manifold unit 39. The manifold unit 39 is provided with a manifold 40 which communicates with the communication portion 23 of the channel forming substrate 21 to serve as a common ink chamber of the respective pressure generating chambers 22 in this embodiment.

Furthermore, the protection substrate 37 is provided with a through-hole 41 which penetrates the protection substrate 37 in a thickness direction. The through-hole 41 is interposed between the two piezoelectric element holding portions 36 in this embodiment. The end-near portion of the lead electrode 34 pulled out from each of the piezoelectric elements 30 is provided so as to be exposed in a through-hole 41.

In addition, on the protection substrate 37, a compliance substrate 46 having a sealing film 44 and a fixing plate 45 is joined. Herein, the sealing film 44 is made of flexible material having low rigidity, and one side of the manifold unit 39 is sealed by the sealing film 44. Further, the fixing plate 45 is made of a hard material such as metal. Since the region of the fixing plate 45 opposite the manifold 40 is completely removed in the thickness direction to form an opening 47, one surface of the manifold 40 is sealed only by the flexible sealing film 44. In addition, the compliance substrate 46 is provided with an ink inlet port 48 for introducing the ink in the manifold 40.

A head case 49 is fixed to the compliance substrate 46. The head case 49 is provided with an ink inlet channel 50 which communicates with the ink inlet port 48 to supply the ink to the manifold 40 from a storage unit such as a cartridge. In addition, the head case 49 is provided with a wiring member holding hole 51 which communicates with the through-hole 41 provided in the protection substrate 37, and one end of the driving wiring 35 is connected to the lead electrode 34 while being inserted into the wiring member holding hole 51.

Each of the head bodies 20 including the configuration is fixed to the case member 60. As shown in FIGS. 1 and 2, the plurality (four in this embodiment) of head bodies 20 is fixed to the bottom side of the case member 60.

The case member 60 is provided with a through-hole 61 penetrating the case member 60 in the thickness direction, and the through-hole corresponds to each of the head bodies 20. The case member 60 is provided with a supply passage 62, which communicates with the ink inlet channel 50 provided in the head case 49 of the head main body 20, at the outer portion of the through-hole 61. The driving wiring 35 of each of the head bodies 20 is inserted into the through-hole 61, and the head case 49 of each of the head bodies 20 is joined to the periphery of the through-hole 61 in a state in which the ink inlet channel 50 communicates with the supply passage 62.

In this instance, a cover head 70 having a window 71 for exposing the nozzles 26 is fixed to the surface of, the nozzle plate 27 side of the head bodies 20 fixed to the case member 60.

The channel member 80 is fixed to the surface of the case member 60 opposite the head main body 20, through a circuit board 90 and a seal member 95 made of rubber material or the like.

The circuit board 90 is mounted with various wiring and electronic components for driving the piezoelectric element 30 as described above. In addition, the circuit board 90 is provided with a connection port 91 which penetrates the circuit board in the thickness direction. The driving wire 35 of head main body 20 is inserted into the connection port 91, and is electrically connected to various wirings or the like of the circuit board 90 at a front end thereof.

The channel member 80 has a channel member body 81 and a cover member 82. The above-described circuit board 90 and the seal member 95 are held between the channel member body 81 configuring the channel member 80, and the case member 60.

In addition, the channel member body 81 has a fixing portion 83 which is fixed to one surface side of a plurality of ink supply needles 100 inserted into the ink cartridge, and a channel forming portion 84 which protrudes from the bottom surface of the fixing portion 83. In the channel forming portion 84, ink supply holes 85 are respectively formed, and one end of the ink supply hole is opened opposite the ink supply needle 100. The other end of the ink supply hole 85 is connected to the supply passage 62 of the case member 60 via the supply communicating passage 96 which is provided in the seal member 95.

In this instance, the opening of the ink supply hole 85 at one end thereof is provided with a filter 110 for removing bubbles or foreign matter in the ink. That is, the ink supply needles 100 are fixed to the fixing portion 83 of the channel member body 81 through the filter 110.

Each of the ink supply needles 100 has a through-passageway 101 therein which communicates with the ink supply hole 85. The ink supply needle 100 is inserted into the ink cartridge (not shown), so that the ink inside the ink cartridge is supplied to the manifold 40 of the head main body 20 through the through-passageway 101 of the ink supply needle 100, the ink supply hole 85, the supply passage 62, and the like.

The cover member 82 has a substantially box shape with an opened bottom side (head main body 20 side), and is integral with the channel member body 81 while being superimposed on the channel member body 81 from the ink supply needle 100 side. Specifically, the cover member 82 includes a bottom portion (upper surface portion) 86 with an opening 87, through which the ink supply needle 100 is exposed, and a wall portion 88 installed to surround the periphery of the channel forming unit 84 and having a height extending to the case member 60.

In the state in which the cover member 82 is superimposed on the channel member body 81 from the ink supply needle 100 side, and the circuit board 90 and the seal member 95 are sandwiched between the channel member body 81 and the case member 60, the cover member 82 and the case member 60 are fixed by, for example, a fastening member 120 such as a screw. Accordingly, the channel member body 81 and the cover member 82 are formed integrally with each other to form the channel member 80, and the channel member 80 and the case member 60 are formed integrally with each other. In this embodiment, the channel member 80 and the case member 60 are fixed to each other by four fastening members 120 each installed at each side thereof (refer to FIG. 1).

In the configuration of the recording head 10 according to the invention, the periphery of the circuit board 90 mounted with the electronic components for driving the piezoelectric elements 30 is covered by the channel member 80 and the case member 60. That is, the circuit board 90 is housed in the space formed between the cover member 82 and the case member 60. Accordingly, it is possible to effectively suppress ink mist generated when the ink droplets are ejected from the nozzles 26 of the head main body 20 or the like, from being adhered to the circuit board 90.

Figure 5:
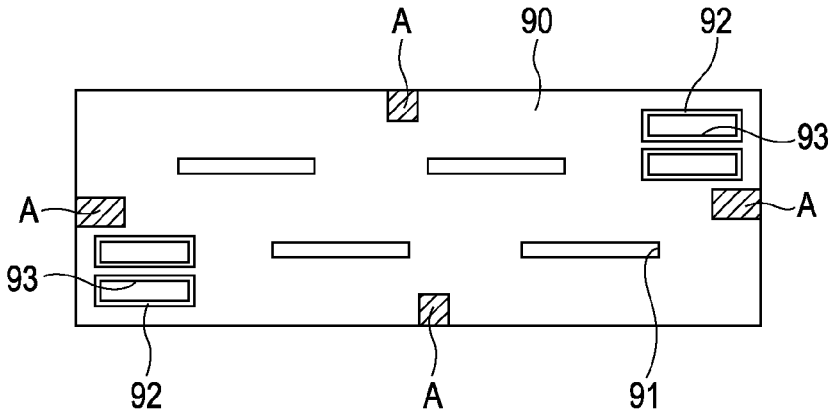
FIG. 5 is a plan view showing a schematic configuration of a circuit board according to an embodiment of the invention.
Figure 6:
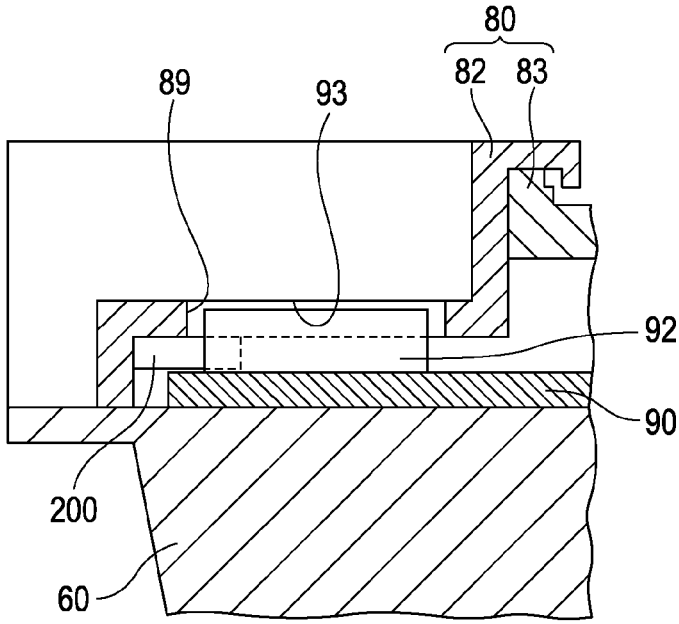
FIG. 6 is a cross-sectional view schematically showing main portions of a recording head according to an embodiment of the invention.

Incidentally, the circuit board 90 is provided with a connector 92 to which the external wiring (not illustrated) is connected. As shown in FIG. 5, the connector 92 is provided at each opposite corner to the circuit board 90 having a substantially rectangular shape in this embodiment. The connector 92 is fixed to the circuit board 90 such that the connection port 93, to or from which the external wiring is inserted or released, is opened toward the channel member 80 side, as shown in FIG. 6. The cover member 82 constituting the channel member 80 is provided with an exposed opening 89 at the region opposite the connector 92, and the exposed opening exposes the connection port 93 of the connector 92. That is, the connection port 93 of the connector 92 is formed such that the external wiring is inserted into or removed from the outside of the channel member 80 through the exposed opening 89.

The channel member 80 (the cover member 82 in this embodiment) includes a deformation restricting portion 200 which is provided in the region opposite the circuit board 90 and substantially abuts against the surface of the circuit board 90. Herein, the expression "substantially abuts" means not only the state in which the deformation restricting portion 200 substantially abuts against the surface of the circuit board 90, but also the state in which the deformation restricting portion 200 is close to the surface of the circuit board 90. That is, the deformation restricting portion 200 may come into contact with the circuit board 90, and some gaps may be present between the deformation restricting portion 200 and the circuit board 90.

The deformation restricting portion 200 is provided so as to protrude from the surface (bottom surface) of the cover member 82, which is opposite the circuit board 90, toward the circuit board 90. In this embodiment, the deformation restricting portion 200 protrudes from the bottom surface of the cover member 82 toward the circuit board 90, and is continuously installed from the lateral surface of the cover member 82.

The position where the deformation restricting portion 200 is provided is not specifically limited, however it is preferable that the deformation restricting portion 200 is provided in the vicinity of the connector 92. In addition, it is preferable that the deformation restricting portion 200 is provided facing the outer periphery of the circuit board 90. For example, in this embodiment, as shown in FIG. 5, four deformation restricting portions 200 are provided in the cover member 82 such that it substantially abuts against a predetermined region A of the periphery portion of each side of the circuit board 90 having a generally rectangular shape.

The installation of the deformation restricting portion 200 suppresses the bending of the circuit board 90. When the external wiring is extracted from the connector 92, the force is applied to the circuit board 90 in such a way that the circuit board is pulled toward the channel member 80. The circuit board 90 is likely to be deformed by the force, however the circuit board abuts against the deformation restricting portion 200, so that the deformation (bending) is suppressed. Accordingly, the external wiring can be satisfactorily extracted from the connector 92. In addition, since the deformation of the circuit board 90 is suppressed, there is no concern that the circuit board 90 may be damaged when the external wiring is extracted from the connector 92. Further, the deformation restricting portion 200 protrudes toward the circuit board 90. For this reason, when the external wiring is extracted from the connector 92, even though the deformation restricting portion 200 is applied by the pressure through the circuit board 90, the deformation restricting portion 200 itself is not damaged.

In addition, as described above, the case member 60 and the channel member 80 are fixed to each other by four fastening members 120, with the circuit board 90 being interposed between the case member and the channel member. These four fastening members 120 are arranged close to each of the deformation restricting portions 200. Thus, when the circuit board 90 abuts against the deformation restricting portion 200, the fastening force generated by the fastening members 120 acts as a force for suppressing the deformation of the circuit board 90. Therefore, the deformation (bending) of the circuit board 90 is more reliably restricted.

Further, by restricting the deformation of the circuit board 90 by the deformation restricting portion 200, it becomes unnecessary to provide a through-hole in the circuit board 90 itself, and thus, it is possible to simplify the structure of the circuit board 90. In addition, since the deformation restricting portion 200 is provided, the rigidity of the cover member 82 is increased, so that there is an effect of increasing the strength of the recording head.

Figure 7:
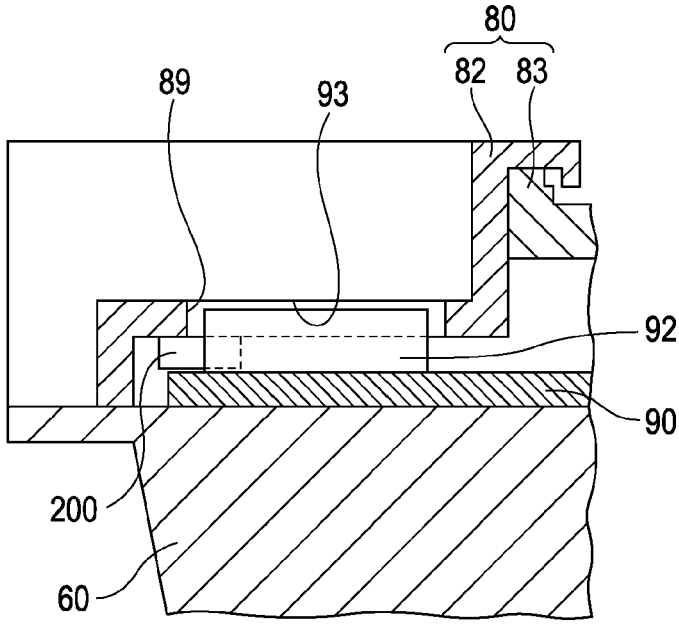
FIG. 7 is a cross-sectional view showing a modified example of a recording head according to an embodiment of the invention.

In this instance, the deformation restricting portion 200 according to the embodiment protrudes from the bottom surface of the cover member 82 toward the circuit board 90, and is continuously installed from the lateral surface of the cover member 82, but, for example, as shown in FIG. 7, may not be connected from the lateral surface of the cover member 82, but may protrude from the bottom surface of the cover member 82 toward the circuit board 90. Such a configuration can, of course, satisfactorily restrict the deformation (bending) of the circuit board 90 by the deformation restricting portion 200.

Although the foregoing has described an embodiment of the invention, of course, the invention is not limited to the embodiment.

For example, in the embodiment described above, the deformation restricting portions are provided at four positions of the cover member, but the number of the deformation restricting portions is not specifically limited thereto. For example, in the configuration in which the connectors are provided at two corners of the circuit board as described above, the deformation restricting portion may be provided at least in the vicinity of each corner of the circuit board provided with the connectors. Of course, the deformation restricting portion may be provided at five positions or more.

In addition, for example, although the above-described embodiment illustrates the configuration in which the deformation restricting portion is provided at the cover member, the deformation restricting portion may be provided in the channel member body. In any case, the deformation restricting portion may be configured to protrude toward the circuit board to substantially abut against the surface of the circuit board.

Further, for example, the above-described embodiment illustrates the configuration in which the channel member is made up of the channel member body and the cover member, however the configuration of the channel member is not specifically limited thereto. For example, the channel member may be formed integrally with the channel member body and the cover member.

Furthermore, for example, the configuration of the head main body described in the above-described embodiment is an example only, and it is not limited thereto. The piezoelectric element of a thin film type is exemplified as the pressure generating element in the embodiment described above, however the configuration of the pressure generating element is not specifically limited thereto. For example, a piezoelectric element of a thick film type that is formed by attaching a green sheet, or a piezoelectric element of a vertical-vibration type in which a piezoelectric material and an electrode forming material are alternately laminated and expanded and contracted in the axial direction, may be used as the pressure generating element. Alternatively, a heater element that is disposed inside the pressure generating chamber and that generates heat to form bubbles and thereby ejects liquid droplets from a nozzle orifice, or a so-called electrostatic actuator that generates static electricity between a vibrating plate and an electrode to deform the vibrating plate by an electrostatic force and thereby ejects liquid droplets from a nozzle orifice, may be used as the pressure generating element.

Figure 8:
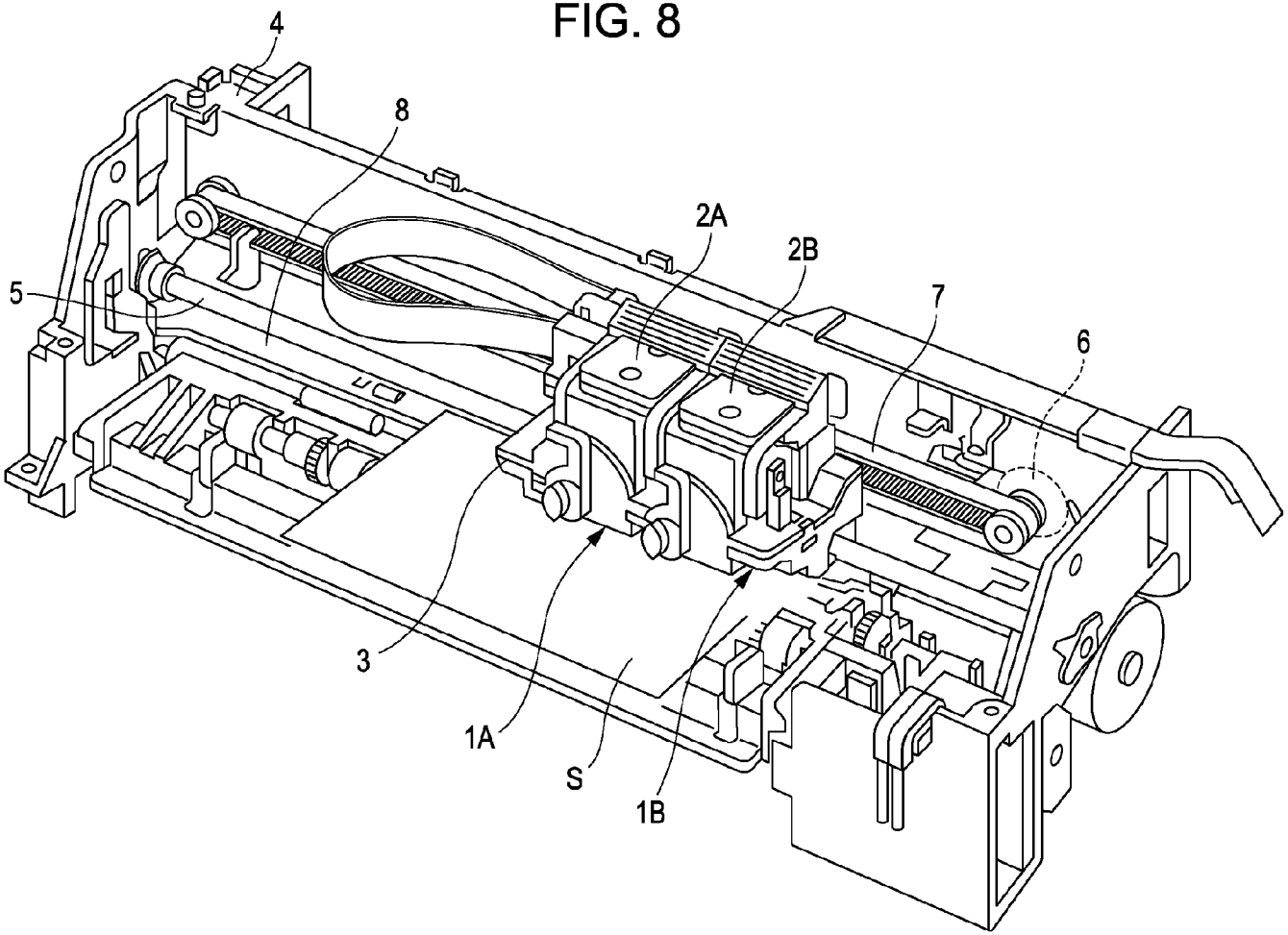
FIG. 8 is a schematic diagram of a recording device according to an embodiment of the invention.
Figure 9:
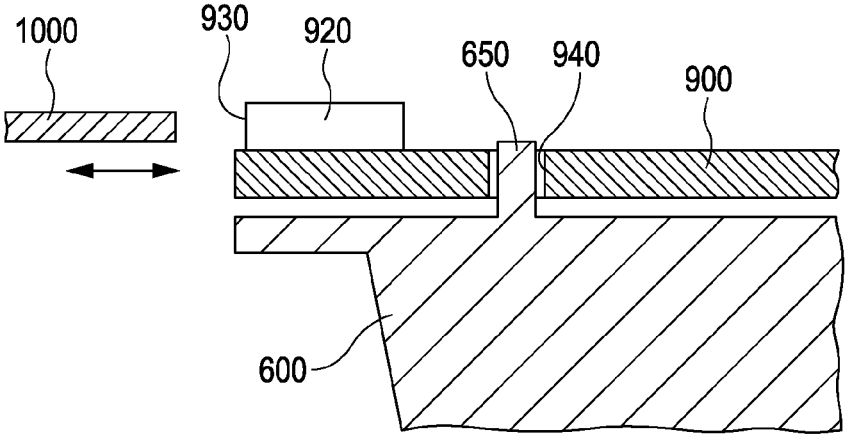
FIG. 9 is a cross-sectional view schematically showing main parts of a recording head in the related art.

The recording head according to the embodiment described above configures a portion of a head unit for an ink jet recording head having an ink channel communicating with an ink cartridge or the like, and is mounted in an ink jet recording apparatus. FIG. 8 is a schematic view illustrating an example of the ink jet recording apparatus.

As shown in FIG. 8, recording head units 1A and 1B having the recording head are provided with detachable cartridges 2A and 2B serving as ink supply units. A carriage 3 on which the recording head units 1A and 1B are mounted is provided on a carriage shaft 5 attached to an apparatus main body 4, so as to be movable in an axial direction. The recording head units 1A and 1B are configured to discharge, for example, a black ink composition and a color ink composition.

The driving force of a driving motor 6 is transmitted to the carriage 3 through a plurality of gears (not shown) and a timing belt 7, and thereby the carriage 3 on which the recording head units 1A and 1B are mounted moves along the carriage shaft 5. In the apparatus main body 4, a platen 8 is provided along the carriage shaft 5, and a recording sheet S serving as a recording medium such as a paper sheet that is fed by a paper feed roller or the like (not shown) is wound around the platen 8 so as to be transported.

In the above-described embodiment, an ink jet recording head is described as an example of the liquid ejecting head. However, the invention is intended for the liquid ejecting head and a liquid ejecting apparatus widely including the same in general. For example, the invention may be applied to various recording heads that are used in an image recording apparatus such as a printer, a color material ejecting head that is used for manufacturing a color filter of a liquid crystal display or the like, an electrode material ejecting head that is used for forming an electrode of an organic EL display, an FED (Field Emission Display), or the like, and a bioorganic material ejecting head that is used for manufacturing a bio chip.

What is claimed is:

1. A liquid ejecting head comprising:

a head main body which ejects a liquid droplet;

a case member to which the head main body is fixed;

a channel member which is fixed to the case member, and has a liquid supply passage which is connected to a liquid storage unit which stores a liquid; and a circuit board which is provided between the case member and the channel member, and is connected to a pressure generating element configuring the head main body, wherein a connector connected to an external wiring is fixed on the circuit board by opening a connection port toward the channel member side, the external wiring is inserted into or released from the connection port, and the channel member has a deformation restricting portion protruding from a region, which is opposite the circuit board, toward the circuit board, and substantially abuts against a surface of the circuit board to restrict deformation of the circuit board to the channel member side.

2. The liquid ejecting head according to claim 1, wherein the deformation restricting portion is provided adjacent to the connector.

3. The liquid ejecting head according to claim 1, the deformation restricting portion is provided at a plurality of positions on an outer periphery of the circuit board.

4. The liquid ejecting head according to claim 1, the case member and the channel member are fixed to each other by a fastening member in a state in which the circuit board is interposed between the case member and the channel member, and the deformation restricting portion is provided adjacent to the fastening member.

5. A liquid ejecting apparatus comprising the liquid ejecting head according to claim 1.

6. A liquid ejecting apparatus comprising the liquid ejecting head according to claim 2.

7. A liquid ejecting apparatus comprising the liquid ejecting head according to claim 3.

8. A liquid ejecting apparatus comprising the liquid ejecting head according to claim 4.

* * * * *